United States Patent [19]

Zurbruggen et al.

[11] 4,410,317

[45] Oct. 18, 1983

[54] SELF-DISCHARGING CENTRIFUGAL DRUM

[75] Inventors: Hugo Zurbruggen; Karl-Heinz Zettier, both of Oelde, Fed. Rep. of Germany

[73] Assignee: Westfalia Separator AG, Oelde, Fed. Rep. of Germany

[21] Appl. No.: 373,200

[22] Filed: Apr. 29, 1982

[30] Foreign Application Priority Data

May 15, 1981 [DE] Fed. Rep. of Germany ..... 3119423

[51] Int. Cl.[3] ..... B04B 11/00

[52] U.S. Cl. ..... 494/4; 494/29; 494/65

[58] Field of Search ..... 494/27, 29, 2, 3, 4, 494/56, 65

[56] References Cited

U.S. PATENT DOCUMENTS

| | | | |
|---|---|---|---|
| 2,022,815 | 12/1935 | Strezynski | 494/4 |
| 2,578,484 | 12/1951 | Nyrop | 494/4 |
| 3,550,843 | 12/1970 | Hoffmann | 494/27 |
| 3,765,599 | 10/1973 | Hemfort | 494/29 |
| 3,871,575 | 3/1975 | Niemeyer | 494/27 |

*Primary Examiner*—Robert W. Jenkins

*Attorney, Agent, or Firm*—Sprung, Horn, Kramer & Woods

[57] ABSTRACT

A self-discharging centrifugal drum for clarifying and separating suspensions has an axially displaceable piston valve that is bounded above by a solids space and that opens and closes expulsion openings in the drum jacket. A closure compartment that can be charged with closure fluid is disposed below the piston valve and into which the closure fluid is supplied through a channel that is connected to an intermediate compartment for closure fluid. The closure compartment is evacuated to initiate discharge of the drum packing by a centrifugal valve. The valve that evacuates the closure compartment is a centrifugal valve that contains a movable valve cone, with the valve cone activated by control fluid and having a valve projection that is smaller in diameter than the valve cone and that is sealed into the drum jacket behind the valve cone so that the valve projection will extensively choke or close the channel that connects the closure compartment to the intermediate compartment when the valve cone opens. This insures not only sudden evacuation but also just as sudden charging of the closure compartment with closure fluid.

8 Claims, 1 Drawing Figure

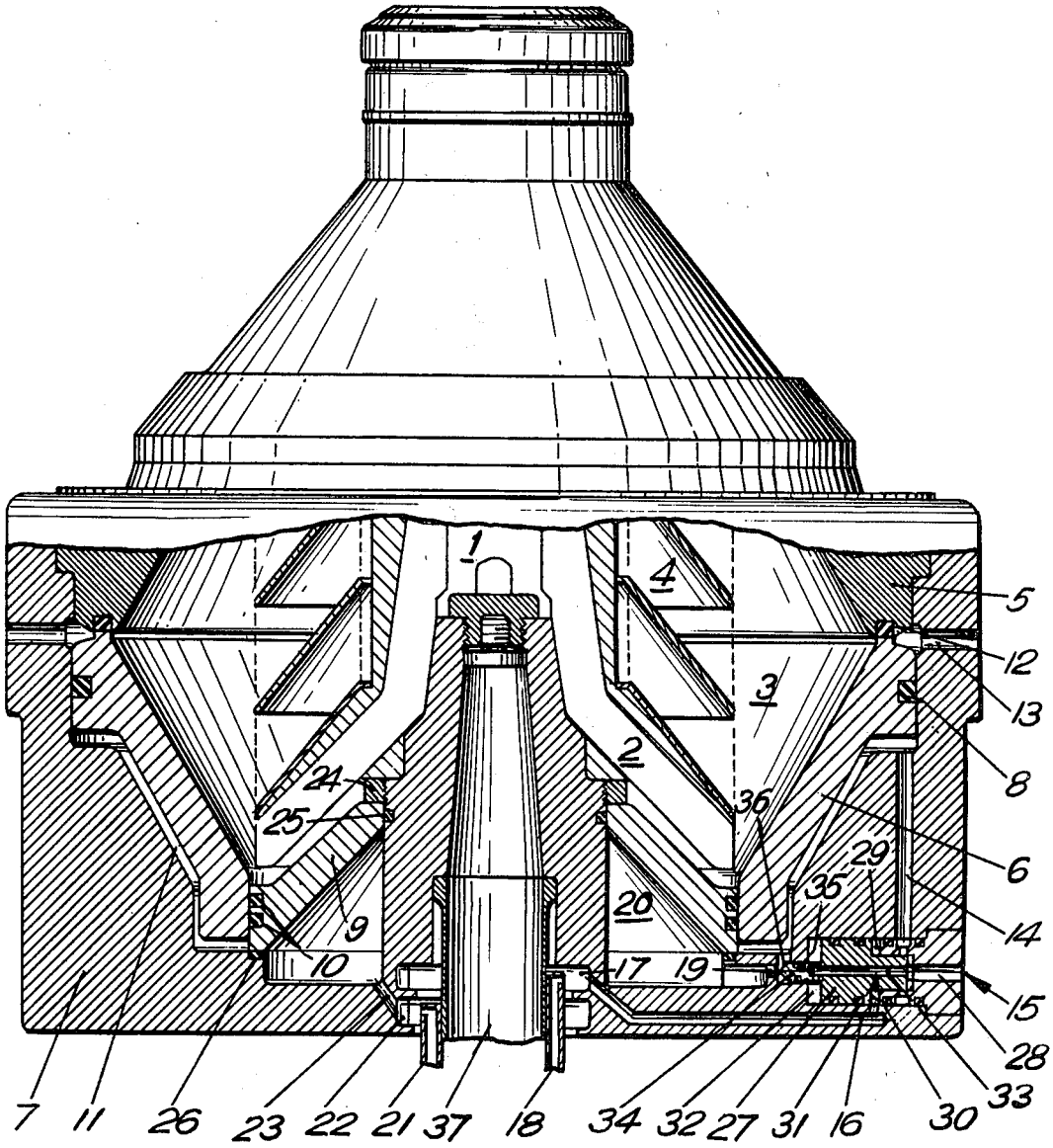
1
4
5
12
13
3
8
2
24
36
25
6
29
35
20
14
9
10
17
19
15
28
33
7
11
26
23
22
21
37
18
34
32
27
31
16
30

SELF-DISCHARGING CENTRIFUGAL DRUM

BACKGROUND OF THE INVENTION

The present invention relates to a self-discharging centrifugal drum for clarifying and separating suspensions that has an axially displaceable piston valve that opens and closes expulsion openings in the circumference of the drum jacket to allow the removal of centrifuged solids, in which the top of the piston valve is demarcated by the solids space and its bottom by a closure compartment into which closure fluid can be pumped, in which the closure fluid is supplied through a channel that is connected to the closure compartment and part of which is an intermediate compartment for closure fluid, and in which there is a valve that is activated by control fluid to evacuate the closure compartment in such a way that, when the valve is activated to withdraw closure fluid from the closure compartment, the closure pressure in the closure compartment is reduced and part of the closure fluid remains in the intermediate compartment.

A centrifugal drum of this type is known for example from German Offenlegungsschrift 3 021 638. In this device an annular valve in the closure compartment axially displaces an annular elastic element that seals the closure compartment off from the outlet to open an outlet gap for closure fluid at the inlet into the closure compartment while the elastic element simultaneously blocks off the connection between the closure compartment and the intermediate compartment.

Uniform delivery of the drum packing and especially of the solids centrifuged into the periphery of the solids space requires both more rapid opening, with a large opening gap between the piston valve and the sealing site in the drum cover, and more rapid closure of the piston valve, especially when discharge is partial.

To obtain a uniformly large opening gap in the drum, which will prevent caked-up solids from getting clogged up in it, the piston valve should travel through a uniform stroke during both total and partial discharge. One practical way to obtain such uniformity is to ensure total evacuation of the closure compartment, which must then be refilled with closure fluid at a rate that depends on the desired level to which the drum is to be discharged.

Although known centrifugal drums, which by the way utilize a very expensive valve, can be opened and closed rapidly, it is extremely difficult to control the opening time. Since the amount of closure fluid in the closure compartment under the piston valve is always constant, it will force the piston valve back into the closure position as soon as the pressure of the closure fluid under the piston valve again becomes somewhat higher than that of the centrifuged fluid in the solids space, which acts on the top of the piston valve. It is therefore also hardly possible with this drum to obtain either complete total discharge or different levels of partial discharge of the drum packing. Furthermore, the constant deformation of the elastic closure element will subject it to extreme wear.

SUMMARY OF THE INVENTION

The main object of the present invention is to provide a simpler and more readily discharged drum of the type disclosed hereinabove.

This objective is attained by employing as the valve that evacuates the closure compartment a centrifugal valve of a type that is in itself known and that contains a movable valve cone, with the valve cone activated by control fluid and having a valve projection that is smaller in diameter than the valve cone and that is sealed into the drum jacket behind the valve cone so that the valve projection will extensively choke or close the channel that connects the closure compartment to the intermediate compartment when the valve cone opens.

The valve cone in accordance with the invention is designed, when employed in a conventional centrifugal valve that evacuates the closure compartment while simultaneously choking or closing securely the channel that connects the closure compartment to the intermediate compartment, to make the valve system extremely simple, wear-resistant, and efficient. It also allows variable evacuation of closure fluid from the closure compartment so that the drum can be accurately discharged either partially or completely.

The combination of a valve piston that is demarcated on the top only by the solids space and below by a small closure compartment that contains only a relatively slight amount of closure fluid results not only in sudden opening during both partial and complete discharge but also in correspondingly more rapid closure because the closure compartment can be charged with fluid from the intermediate compartment, which is under higher pressure. The closure compartment will be charged automatically, as soon as the centrifugal valve closes the evacuation channel from the closure compartment when the supply of control fluid subsides, because the valve cone will simultaneously open the channel that connects the intermediate compartment to the closure compartment.

The piston valve will continue to open only as long as enough control fluid is being supplied to the centrifugal valve. Whereas the valve projection will completely close off the channel during complete discharge, it can also be positioned to only choke the channel extensively and obtain any desired level of partial discharge.

The smallness of the closure compartment in relation to the intermediate compartment ensures not only rapid evacuation but also just as rapid charging of the closure compartment, providing a maximum piston-valve opening gap during both partial and total discharge.

Further features and characteristics of the invention will be evident from the following disclosure including the detailed description of a preferred embodiment and the drawing wherein:

BRIEF DESCRIPTION OF THE DRAWING

The FIGURE is a partial sectional view of a centrifugal drum according to the present invention.

DETAILED DESCRIPTION OF THE INVENTION

The suspension flows from access compartment 1 through channels 2 into solids space 3 and into a separation space 4 that consists of a series of disks, where it is clarified and separated by a known process. The solids space is bounded above by drum cover 5 and below by an axially displaceable piston valve 6 that is sealed off from drum jacket 7 by a ring seal 8 and from an intermediate floor 9 by ring seals 10. When the centrifugal drum is in operation, the piston valve is maintained in its upper, closure, position by a closure compartment 11 underneath it and charged with closure fluid. In this position the front of the piston valve works in conjunction with a ring seal 12 in drum cover 5 to seal off solids space 3 from expulsion openings 13 in the circumference of drum jacket 7 that allow the accumulated solids to be ejected. Closure compartment 11 is evacuated through an evacuation channel 14 that leads from its circumference to a fluid-activated centrifugal valve 15 that is itself connected by an afflux channel 16 to an annular channel 17 near the axis of the drum jacket and supplied with control fluid through a supply connection 18.

The inside of closure compartment 11 is connected by a nozzle-shaped channel 19 to an intermediate compartment 20 that can itself be supplied with closure fluid through an annular channel 22 and a channel 23 from a supply connection 21. Intermediate compartment 20 is bounded below by drum jacket 7 and above by an intermediate floor 9 that is firmly mounted in the drum jacket by a threaded ring 24 and sealed off from the jacket by ring seals 25 and 26. The capacity of intermediate compartment 20 is larger than that of closure compartment 11.

Centrifugal valve 15, which is involved in evacuating closure compartment 11 and which is sealed into drum jacket 7, contains a movable valve cone 27 that, when affected by the centrifugal force that occurs when the device is in operation, seals evacuation channel 14 off from an outlet 28 in centrifugal valve 15. Afflux channel 16, which supplies control fluid, opens into an annular channel 29 in centrifugal valve 15. During operation, when control fluid is supplied, the fluid pressure in afflux channel 16 affects the front 30 of valve cone 27. Annular channel 29 and hence afflux channel 16 are evacuated, when the supply of control fluid ceases, through an evacuation channel 31 in valve cone 27 that is smaller in diameter than afflux channel 16 and through channel 33 that leads into outlet 28 and that also serves as a vent for compartment 32.

There is a valve projection 34 on the rear of valve cone 27 that is sealed into drum jacket 7 with a ring seal 35 and that closes or extensively chokes the channel 19 that connects closure compartment 11 to intermediate compartment 20 when the device opens. Since the outside diameter of valve projection 34 is considerably smaller than that of the front of valve cone 27, the fluid pressure on the front 30 of the valve cone in annular channel 29 will be higher while control fluid is being supplied than that deriving from the fluid-charged intermediate compartment 20 and affecting the front 36 of valve projection 34 in channel 19.

The centrifugal drum itself rotates on a central shaft 37. Its function will now be specified.

During operation, when centrifugal valve 15 is closed, closure compartment 11, the open channel 19, and intermediate compartment 20 are charged with closure fluid. Piston valve 6 is in its upper, closure, position, in which it closes off expulsion openings 13.

When solids space 3 is full of solids and the drum is to be partially or completely discharged depending on the nature of the solids or of the suspension, centrifugal valve 15 is charged with control fluid through annular channel 17 and afflux channel 16 from supply connection 18. The fluid pressure that affects the front 30 of valve cone 27 and that derives from the fluid in afflux channel 16 and annular channel 29 causes valve cone 27, which is subject to centrifugal force, to open evacuation channel 14, allowing closure fluid to escape from closure compartment 11 through outlets 28.

As seeon, however, as a small amount of closure fluid leaves closure compartment 11 two events occur. First, the fluid connection through channel 19 between closure compartment 11 and intermediate compartment 20 breaks down. Second, the outlet from channel 19 will be extensively choked or closed by valve projection 34 at valve cone 27 as soon as the pressure of the control fluid in annular channel 29 begins to affect the front of the valve cone and displaces it toward the axis of rotation, upon which the fluid pressure below piston valve 6 will suddenly drop, allowing the pressure built up in solids space 3 and separation space 4 to force piston valve 6 just as suddenly down into its lower, opening, position.

Part or all of the drum packing will now be expelled from solids space 3 through expulsion openings 13. Since evacuation channel 14 begins at the outside of closure compartment 11, it is possible to completely evacuate the closure compartment, so that the piston valve can attain both its lowest possible position and a maximal opening width.

The time required for centrifugal valve 15 and hence piston valve 6 to open is determined by the supply of control fluid as a function of either time or quantity. This supply can also be employed to determine the amount of solids to be centrifuged out of the solids space.

As soon as the supply of control fluid decreases or stops, valve cone 27 will, under the influence of centrifugal force and of the constant pressure of the fluid from intermediate compartment 20 on the front 36 of valve projection 34, cause the valve projection to open channel 19, simultaneously closing evacuation channel 14, so that the closure fluid from the intermediate compartment, which is subjected to a high fluid pressure that may, depending on the diameter and speed of revolution of the drum, reach 25 bars or more, will immediately flow into the partially or completely vacuated closure compartment 11 and recharge it. It is practical for the cross-section of channel 19 to be larger than that of evacuation channel 14.

While the drum is being discharged, in addition to the control fluid, the amount of which is very slight, fresh closure fluid will be simultaneously supplied from supply connection 21 through annular compartment 22 and channel 23 to intermediate compartment 20. It will be practical for control and closure fluid to be supplied during discharge from supply connections 18 and 21 through appropriate controls, which are not illustrated.

It will be appreciated that the instant specification and claims are set forth by way of illustration and not limitation, and that various modifications and changes may be made without departing from the spirit and scope of the present invention.

What is claimed is:

1. In a self-discharging centrifugal drum for clarifying and separating suspensions, the drum having a drum jacket, an axially displaceable piston valve that opens and closes expulsion openings in the circumference of the drum jacket to allow the removal of centrifuged solids, the piston valve being bounded above by a solids space and below by a closure compartment into which closure fluid is chargeable, a closure fluid supply channel connected to the closure compartment including means forming an intermediate compartment for closure fluid and valving means activated by control fluid for evacuating the closure compartment by reducing the closure pressure in the closure compartment and leaving a part of the closure fluid in the intermediate compartment, the improvement wherein the supply channel includes a first channel connecting the intermediate and closure compartments and the valve means comprises a centrifugal valve containing a radially movable cylindrical valve cone activated in response to control fluid applied thereto under pressure and having a valve projection fixed thereto which is smaller in diameter than the valve cone and projects radially inwardly therefrom and wherein the valve projection is sealed into the drum jacket behind the valve cone to close the first channel, when the valve cone opens.

2. The self-discharging centrifugal drum according to claim 1, wherein the first channel includes a nozzle-like boring therein.

3. The self-discharging centrifugal drum according to claim 1 or claim 2, wherein the valving means includes an evacuation channel to the closure compartment and wherein the cross-section of the first channel is larger than that of the evacuation channel.

4. The self-discharging centrifugal drum according to claim 3, wherein the first channel begins at the outer periphery of the intermediate compartment and opens into the interior of the closure compartment.

5. The self-discharging centrifugal drum according to claim 4, wherein the evacuation channel begins at the outer periphery of the closure compartment.

6. The self-discharging centrifugal drum according to claim 1, wherein the closure-fluid capacity of the intermediate compartment is larger than that of the closure compartment.

7. The self-discharging centrifugal drum according to claim 1, wherein the means forming the intermediate compartment comprises an intermediate floor fixed in the drum jacket and defining the intermediate compartment therebetween.

8. The self-discharging centrifugal drum according to claim 1, wherein the valve cone is sealed off from the drum jacket by a ring seal.

* * * * *